US006006561A

United States Patent [19]

Hill et al.

[11] Patent Number: 6,006,561

[45] Date of Patent: Dec. 28, 1999

[54] ELECTRONIC RESET FOR SOLENOID ACTIVATED CONTROL IN AN ELECTRONIC LOCK

[75] Inventors: James D. Hill; William Fain Irving, both of Lexington; James Thomas Loiselle, Nicholasville; Joseph W. Luciano, Lexington; Kenneth H. Mimlitch, Lexington; John E. Passafiume, Lexington, all of Ky.

[73] Assignee: Mas-Hamilton Group, Inc., Lexington, Ky.

[21] Appl. No.: 08/852,775

[22] Filed: May 7, 1997

[51] Int. Cl.[6] ..... E05B 47/00

[52] U.S. Cl. ..... 70/276; 70/278; 70/303 A

[58] Field of Search ..... 70/276–283, 303 A, 70/303 R; 340/825.31, 825.32, 825.34, 527, 529; 361/171, 172

[56] References Cited

U.S. PATENT DOCUMENTS

| | | | |
|---|---|---|---|
| 4,106,316 | 8/1978 | Tippin | 70/303 A X |
| 5,184,491 | 2/1993 | Schittenhelm | 70/278 |
| 5,307,656 | 5/1994 | Gartner et al. | 70/303 A X |
| 5,542,272 | 8/1996 | Heinemann | 70/303 A X |
| 5,613,388 | 3/1997 | Murphree | 70/278 |
| 5,632,169 | 5/1997 | Clark et al. | 70/278 |
| 5,640,862 | 6/1997 | Remenicky | 70/278 |
| 5,653,135 | 8/1997 | Miller et al. | 70/303 A |
| 5,775,142 | 7/1998 | Kim | 70/278 |
| 5,777,559 | 7/1998 | Dawson et al. | 70/278 X |

*Primary Examiner*—Suzanne Dino Barrett
*Attorney, Agent, or Firm*—Ron Letson; Frost & Jacobs LLP

[57] ABSTRACT

The technique for electronically resetting a magnetically sealed solenoid to an unattracted, unactuated position is described for use with solenoids which have either a residual magnetic or a permanent magnet holding force necessary to retain the armature of the solenoid in its actuated position until such time as the armature is either physically displaced by a mechanical force or an electronic signal is applied to the solenoid. This displacement creates a reverse polarity magnetic field, effectively overcoming the magnetic field acting to hold the armature in its actuated position, permitting a small mechanical force to reset the armature. In order to prevent a lock or similar device from being conditioned for opening and possibly left in that condition for a significant period of time while unattended, jeopardizing the security of the container and its contents, the actuation of the armature in the reset or release phase may occur a relatively short time following its actuation.

10 Claims, 3 Drawing Sheets

ELECTRONIC RESET FOR SOLENOID ACTIVATED CONTROL IN AN ELECTRONIC LOCK

FIELD OF INVENTION

This invention relates to electronic locks which utilize solenoids to control the lock opening operations and, more particularly, to solenoids which are fired electronically and which then remain in the activated position for a period of time, thereby permitting the operator to withdraw the bolt and open the lock.

BACKGROUND OF THE INVENTION

Solenoids used in electronic locks typically act to displace some member of the mechanical controls of the lock such that the remainder of the mechanical controls in the lock may function to withdraw the bolt and thereby open the lock. Some solenoids that have been used in previous electronic locks required either prolonged current flow through the solenoid to maintain the solenoid in its activated or actuated position, or a mechanical latching mechanism to hold the activated mechanism in its activated position until the lock is physically opened. A latch typically requires a reset input to return the lock to its locked secured condition.

Solenoids of the push type typically have an armature which, upon the actuation of the solenoid by an electrical voltage applied thereto, extends from the body of the solenoid. The solenoids attract or pull an armature toward the solenoid housing and body; and, if the armature is such that it is pulled into contact with the body of the solenoid and no restore force is applied to the solenoid armature, then the armature seals and remains sealed to the solenoid body even after the electrical potential and current are removed from the solenoid. This sealing of the armature plate to the solenoid body commonly found on most push-type solenoids is referred to as a magnetic seal.

Solenoids of the push-type typically are supplied from the manufacturer with a relatively thin, non-magnetic spacer or shim interposed between the armature plate and the solenoid body to prevent the armature plate from making contact with the solenoid body. This spacer keeps the armature plate sufficiently away from the body so that whenever the activating voltage is removed, any residual magnetic field in the housing and core of the solenoid will be displaced from the solenoid armature plate sufficiently that the residual magnetic field cannot hold the solenoid armature in a sealed position. On the other hand, without the spacer present, the armature plate seals against the solenoid body, and there may be insufficient mechanical restoration force available to reset the solenoid to its unactuated position. Accordingly, the armature will remain in its actuated or picked position and will maintain the set condition whereby the lock is conditioned for opening and, therefore, is unlocked and insecure.

In locks using the sealing characteristic of the solenoid without the spacer, mechanical resets are necessary to break or overcome both the residual magnetic attraction force and the sealing of the armature and armature plate to the solenoid body. In order to accomplish the resetting function, mechanical resets require some action such as a manual operator input or the withdrawal of the bolt. If the armature plate is sealed to the solenoid body and there is either insufficient or no mechanical force applied to the armature to cause it to reset to its unactuated position, then the residual magnetism found in a solenoid which does not have a non-magnetic spacer may hold the armature in the actuated position.

If the solenoid is first activated and then restores under a sufficiently strong mechanical reset force immediately upon the deactivation of the solenoid's voltage source, the lock components and particularly the solenoid armature will reset and any displaced mechanical elements which are not latched in place, similarly will reset. This results in a lock which is only subject to being opened while the voltage potential is applied to the solenoid and the armature is in its actuated position.

The maintaining of a continuous voltage potential and current flow on and through the solenoid is a substantial power constraint on the design of the self-powered locks wherein all the power necessary to operate all aspects of the lock is derived from a manually operated electrical generator. Locks which are self-powered and have a manually operated generator contained within the lock typically are incapable of maintaining any substantial voltage and current flow for any significant length of time and, therefore, it is impractical to maintain an actuating current for a time sufficient for the operator to withdraw the bolt and, for battery powered locks, the battery life is substantially reduced.

OBJECTS OF THE INVENTION

It is an object of the invention to electrically reset within a predetermined time period the actuating solenoid and the lock to a locked position.

It is another object of the invention to prevent the lock from remaining for an extended period of time in a condition for bolt withdrawal.

It is a further object of the invention to release the magnetically held control element by an electrical command issued to the solenoid.

SUMMARY OF THE INVENTION

Electronic locks typically have a microprocessor or other electronic logic controls to produce appropriate control signals for the operation and control of the lock. In locks with solenoid controls, one such signal is a signal to pulse or pick the solenoid to condition the remainder of the lock mechanism to be opened by the operator. It is a very desirable feature to use a solenoid which is capable of being magnetically sealed in order to hold for a period of time the mechanical apparatus in an opening condition following the dissipation or the removal of the voltage source from the solenoid. If the individual operating the lock is not extremely quick in the manipulation of the dial or other element of the lock to cause withdrawal of the bolt following the conditioning of the solenoid, then the mechanism of the lock will not permit the individual to operate the lock mechanism to open it. At the least, this defeats the purpose of the lock in that it cannot be reliably opened and it creates a condition which is unacceptable from a human factors standpoint.

Using a solenoid which is capable of sealing and being retained in its actuated position following the termination of the actuating electrical voltage, the lock is capable of being opened following the actuation of the solenoid, without maintaining an activating or holding voltage on the solenoid. Locks using electromagnetic devices, such as a solenoid, to condition a portion of the mechanism of the lock for opening upon actuation and consequently the solenoid remains sealed are very advantageous in this respect. However, such a lock will require a secondary mechanism to reset the solenoid and to return the lock to a locked condition.

Typically, locks which have this feature rely upon a mechanical input to the solenoid to displace the armature and armature plate sufficiently to remove the armature plate from proximity to the magnetic field to release it from its actuated condition. Because the lock is conditioned for opening upon the actuation of the solenoid, the period during which time the operator may manipulate the lock dial or other unlocking input member is indeterminate; and, therefore, the lock is left in a vulnerable condition for unlocking until such time as the lock bolt is withdrawn, the lock is unlocked, and the solenoid is reset. The lock described herein is provided with a release or reset circuit which causes the solenoid in response to an electrical signal to reset from its actuated position to its unactuated position.

The armature plate on the armature of the solenoid is magnetically held to the solenoid body in a sealed state by the magnetic field emanating from the core and solenoid housing. This magnetic field is a residual magnetic field which remains as a result of the incomplete restoration of the magnet core and the solenoid housing to an unmagnetized state upon the removal of the electrical potential from the solenoid coil.

In order to reset the solenoid, a circuit provided in the electronic controls for the lock is responsive to a signal from the microprocessor which controls the operation of the lock. The controlled circuit is connected such that it will provide an electrical input to the solenoid and cause the solenoid to lose its residual magnetic holding force, thereby permitting a low-level mechanical force to restore the solenoid armature to its unactuated position.

Two types of solenoids may be used with this particular type of release circuit. One configuration allows the armature plate of the solenoid armature to magnetically seal in contact with the solenoid housing and then the armature is held by the residual magnetic attraction of the field emanating from the solenoid core and solenoid housing in the sealed position. The second type of solenoid which may be used with the release circuit is the type whereby the solenoid includes a permanent holding magnet which holds the armature in its magnetically attracted or actuated position, subject to release. The permanent magnets in this type of solenoid provide a significantly higher level or greater holding force than can be obtained with the residual magnetism of the typical push solenoid.

Both of the foregoing types of solenoids are used in designs wherein the solenoid must remain sealed magnetically for at least a short period of time following its electronic or electrical activation thereby permitting the operator to take some action to withdraw the bolt and open the lock.

To relock the bolt, in instances where the bolt is not withdrawn promptly, the microprocessor performs a short time-out and thereafter sends a short electrical pulse signal to a control circuit to conduct a capacitively stored charge to the solenoid. The capacitor charge is such that the current flow through the coil of the solenoid is in the direction opposite to that of the current flow used to pick the solenoid. This opposite direction current flow will create a magnetic field in the coil. The created magnetic field has an opposite polarity to the magnetic field generated by the solenoid coil during normal actuation. The reversed polarity of the magnetic field will negate or neutralize the residual magnetic field of the solenoid body; moreover, in any event, if not completely negated or neutralized, the residual magnetism will be reduced so that the holding force on the armature plate will be less than the spring force acting through mechanical linkage onto the armature. The net spring force then will be sufficient to restore the mechanical mechanism thus restoring the lock to the secured or locked state.

The electrical pulse provided to the solenoid for resetting the solenoid may be a voltage at or below the actuation voltage applied to the solenoid during the operational service. In the preferred embodiment, where residual magnetism is the holding force, the reset pulse must be significantly shorter, preferably about one order of magnitude shorter, than the actuation pulse in order to prevent the resealing of the armature plate against the solenoid housing in response to the newly created residual magnetic field. Where the holding force is a permanent magnet field, the reset pulse length may be longer, i.e., approximately equal to the pick pulse. The reset voltage may be, but need not be, a substantially smaller voltage than the actuation voltage. The voltage applied for purposes of resetting the solenoid and overcoming the residual magnetism need only be sufficient to create a magnetic field of sufficient intensity to neutralize or overcome the residual magnetism in the core and housing of the solenoid. The release of the armature allows the spring force exerted on the armature through the mechanical elements of the lock to restore the armature to its unattracted position and to restore the mechanical elements of the lock which have been previously displaced as a result of the actuation of the solenoid.

A more detailed understanding of the invention may be had from the attached drawings and detailed description of the invention which follows.

A BRIEF DESCRIPTION OF THE DRAWINGS

A DETAILED DESCRIPTION OF THE PREFERRED EMBODIMENT OF THE BEST MODE

CONTEMPLATED FOR CARRYING OUT THE INVENTION

The following description is that of the preferred embodiment of the best mode which the inventors contemplated for carrying out the invention and should be considered in conjunction with the drawings described above.

Figure 1:
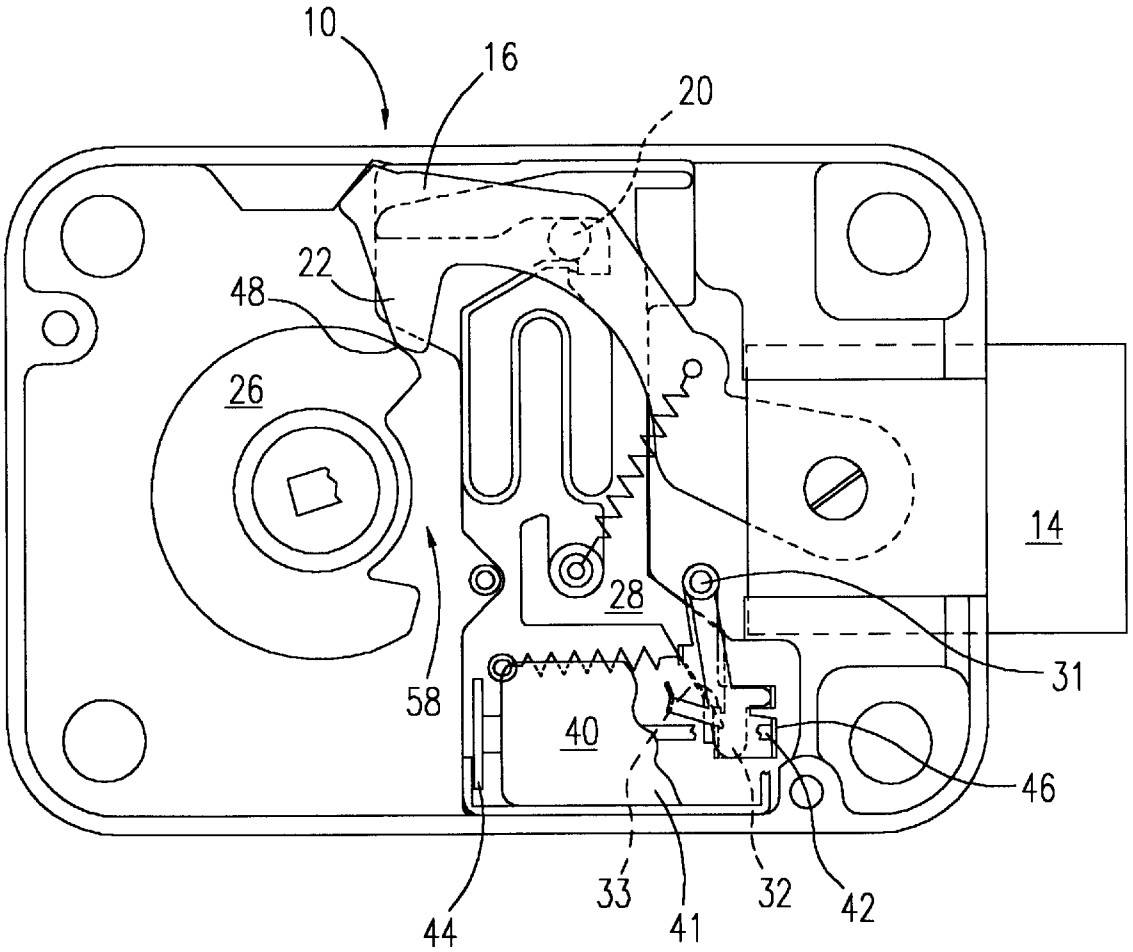
FIGS. 1 and 2 are illustrations of an electronic lock mechanism with the back cover and electronic controls removed to reveal the solenoid and the electromechanical elements of the lock.

Referring initially to FIG. 1, the lock 10 includes a solenoid 40 which is a typical push-type solenoid having an armature plate 44 attached to or formed as one end of the armature or armature shaft 42 and extendible upon actuation of the solenoid 40 from the solenoid housing 41. The solenoid armature 42, upon extension, engages latch input tab 46. Movement of the armature 42 in the attracted direction will displace latch input tab 46 about pivot 31 and simultaneously displaces latch 32 counter clockwise about pivot 31. As can be seen in FIG. 1, the cam 26 acting through nose portion 22 of bolt lever 16 and tenon 20 maintains slide 28 in a raised position freeing latch 32 for movement under the influence of latch input tab 46, whenever latch input tab 46 is pushed by armature 42.

Figure 2:
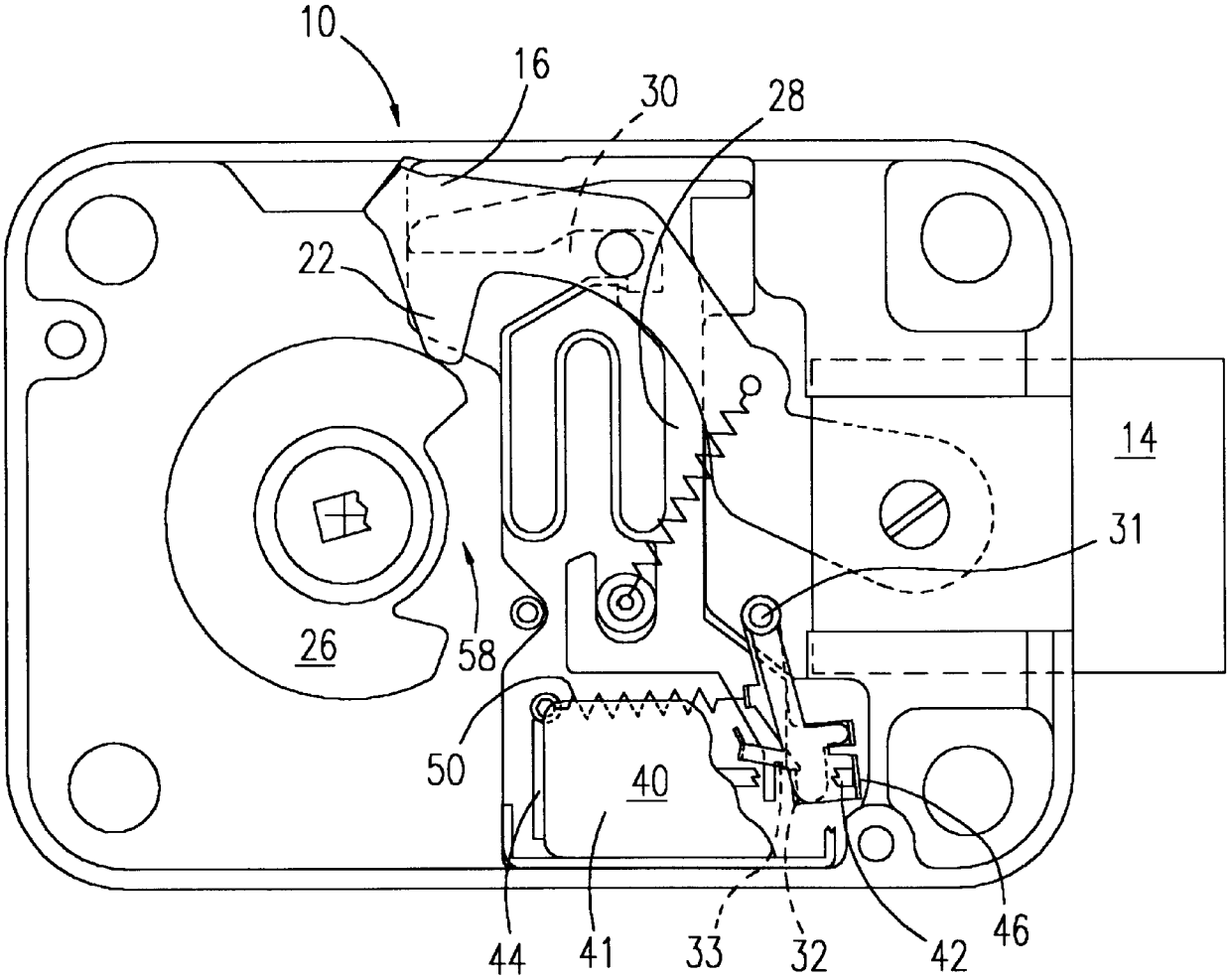

The lock illustrated in FIG. 2 is in the same condition as in FIG. 1 except that the solenoid 40 has been actuated. As can be seen from a review of FIG. 2, the lock at this point has been unlatched; and whenever cam 26 ceases to hold bolt lever 16 in its raised position, maintaining slide 28 in its raised and retracted position, the slide 28 will be free to move. However, until such time as cam 26 is rotated to present the gate 58 to nose portion 22, the residual magnetism in solenoid 40 will maintain the armature plate 44 sealed against solenoid housing 41 with armature 42 extended and holding latch 32 out of engagement with slide 28 and particularly out of engagement with latch notch 33. The residual magnetic attractive force holding armature plate 44 exceeds the spring restore force exerted by spring 50 on latch 32.

During the time period that the lock 10 is in the condition illustrated in FIG. 2, notwithstanding the fact that bolt 14 remains extended, the lock 10 is conditioned for opening and thus is considered unlocked or insecure. It should be recognized that once latch 32 has been disengaged from latch notch 33 and remains disengaged, the only occurrence necessary to open the lock 10 and withdraw the bolt 14 is to turn cam 26 in a counter-clockwise direction.. During the period when the lock 10 is insecure, as is illustrated in FIG. 2, latch restore spring 50 is extended but exerts a force insufficient to overcome the residual magnetic holding force between the solenoid housing 41 and armature plate 44; therefore, the latch 32 will not restore to its locked position until such time as either the lock 10 is operated by the operator to withdraw bolt 14 or until such time as some external influence resets solenoid 40.

Figure 3:
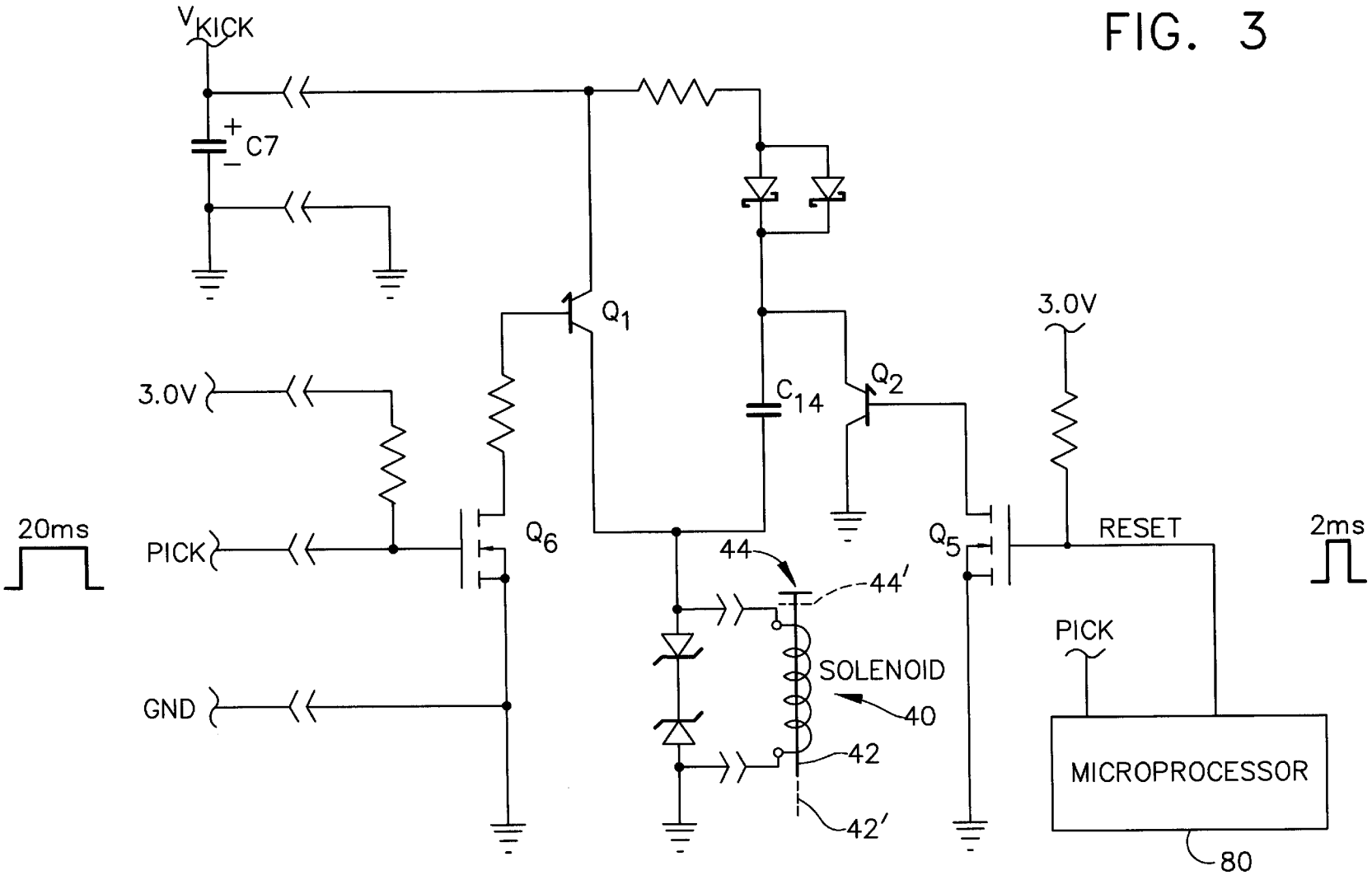
FIG. 3 is a schematic of a circuit which is responsive to microprocessor control and which, in turn, acts to provide a reverse polarity voltage and current flow through the solenoid in response to a command pulse from the microprocessor.

Referring to FIG. 3, the solenoid control circuit is shown. The windings of solenoid 40 are illustrated with the armature plate 44 and the armature 42. The armature 42 and armature plate 44 illustrated in the solid line position are in the unactuated position with the dotted line position showing the actuated position. The electrical power to control the solenoid 40 is supplied by $V_{KICK}$ which is a voltage provided by manually powered generator preferably self-contained within the lock. $V_{KICK}$ acts to charge capacitor C7 and simultaneously charge capacitor C14. Capacitor C7 is a very large capacitance capacitor and has a nominal charging level of approximately twelve volts. Capacitor C14 similarly has a twelve volt charging level but may a very much smaller capacitor and is used to reset the solenoid. The size of capacitor C7 is determined by the intensity of the magnet holding field. The capacitor C7 is connected through transistor Q1 to the solenoid 40 and is controlled to act upon solenoid 40 only under the influence of transistor Q6. Transistor Q6 is controlled by the pick signal from microprocessor 80. The pick signal, typically 20 ms in duration and with a voltage of approximately three volts, the typical output voltage of microprocessor signals is impressed upon the PICK line which then causes transistor Q6 to conduct. Upon transistor Q6 becoming conductive, the potential on the base of transistor Q1 is reduced, causing transistor Q1 to conduct passing the electrical energy from capacitor C7 through the windings of solenoid 40 to ground. The current flowing from capacitor C7 through transistor Q1 and through the windings of solenoid 40 creates a magnetic field which attracts armature plate 44 and armature 42 from the solid line position 44, 42 to the dashed line position 44', 42'. The solenoid 40 only will be energized for approximately 20 ms, the length of time that the pick signal is present on transistor Q6.

When capacitor C7 was charged by voltage $V_{kick}$, capacitor C14 was simultaneously charged. Capacitor C14 was not discharged at the time that capacitor C7 was discharged and, therefore, the charge on capacitor C14 remains available. After the pick signal is no longer present on transistor Q6, armature 42 and armature plate 44 will remain sealed against the solenoid 40 (40', 44' in FIG. 3). The latch 32 illustrated in FIGS. 1 and 2 is held in its displaced and unlatched condition by the residual magnetism of the solenoid 40. In this condition the lock 10 is insecure and capable of being opened by anyone who rotates the dial, not shown, to retract the bolt 14 illustrated in FIGS. 1 and 2 and as described earlier.

Microprocessor 80, as is typical of most microprocessors, is capable of timing periods; upon the initiation of the pick voltage on transistor Q6 by microprocessor 80, the microprocessor 80 then will start timing. After a predetermined period of time, for example, six seconds, microprocessor 80 will initiate a reset pulse on the gate of transistor Q5. With gate of transistor Q5 high, the transistor Q5 will conduct to ground and will pull the base of transistor Q2 to ground causing transistor Q2 to conduct and provide a discharge path between capacitor C14 and ground. With the discharge path from C14 to ground completed, capacitor C14 will discharge and will effectively create a current flow from ground to the negative side of capacitor C14 through the windings of solenoid 40. In the preferred embodiment, when this occurs, as defined by the capacitance of C14, the current will result in a short and relatively low-level current flow as compared to the actuating current flow through solenoid 40 from the capacitor C7.

The low or small current flow resulting from the discharge of capacitor C14 to ground through transistor Q2 will create a low intensity, reverse polarity magnetic field in the windings, core and housing 41 of solenoid 40. This low-intensity magnetic field will cancel, negate, or neutralize the residual magnetic field in the solenoid 40 resulting from the magnetization of the solenoid 40 whenever capacitor C7 was discharged through the solenoid 40. Once the magnetic holding force created by the residual magnetic field within solenoid 40 is counteracted or overcome to the extent that it creates a net holding force weaker than the reset force of restore spring 50 illustrated in FIGS. 1 and 2, latch 32 will be pulled by restore spring 50 into a position to engage latch notch 33 in slide 28 and return the lock 10 to a locked and secured condition.

The period of time between the actuation of solenoid 40 by the discharge of capacitor C7 and the reset or release of the solenoid 40 by the discharge of capacitor C14 may be controlled by programming the microprocessor 80 to time a predetermined time period. The time period should be short enough that the lock 10 vulnerability is minimized while, at the same time, long enough to provide adequate opportunity for the operator of the lock 10 to react to the entry of a proper combination and turn the dial or move a manual input member to withdraw the bolt.

As is explained in a co-pending patent application, Ser. No. 08/852,854 (Docket MH9-97-002) filed on even date herewith by Walter R. Evans, et. al., the opening of the lock 10 will actuate a mechanical reset which will have the effect of restoring the armature 42 of the solenoid 40 to its unattracted position and repositioning the latch 32 to engage latch notch 33 in slide 28. Accordingly, if the manual manipulation of the lock 10 to withdraw the lock bolt 14 to an unlocked position occurs prior to the completion of the timeout period, then the solenoid 40 is reset; and, the lock 10 is conditioned so that the latch 32 will engage latch notch 33 whenever the bolt 14 again is extended to its locked position. In any event, the time-out in the microprocessor 80 will result in the release signal on the gate of transistor Q5 initiating the reset operation. The electronic reset operation under these circumstances will be ineffectual if the solenoid 40 already has been restored to its unattracted, unactuated position.

One will appreciate from the foregoing that the electronic reset capability provides a higher level of security to the lock particularly in those instances whereby the operator may be distracted upon entering the combination and conditioning the lock for opening but, for some reason, fails to physically withdraw the bolt. Thus, the operator fails to operate the mechanical linkages and parts within the lock sufficient to restore the solenoid armature to its unattracted position and restore the latch to a position whereby the lock is incapable of being opened at a later time without the use of the proper combination and operational sequences.

In instances that the restore spring force is necessarily significantly larger and clearly will exceed the level of force exerted by the residual magnetism of the solenoid, a permanent magnet may be used to hold the armature. A permanent magnet holding solenoid has a permanent holding magnet arranged relative to the armature which is capable of holding the armature of the solenoid in its actuated, attracted position; the solenoid may be used so that it does not have to remain powered during the entire period of time necessary for the operator to be able to open the lock. Actuation of the solenoid coil with a reverse current flow as described above can be used to overcome or oppose the magnetic field of the permanent holding magnets and thus reduce the net magnetic holding force on the armature to a level less than that exerted by the mechanical restore springs, thereby permitting the mechanical restore springs both to act and restore the solenoid armature to its unattracted position.

Where the magnetic field intensity is required to be large, a larger or multiple capacitor may be used to achieve the magnetic field initially required for resetting, Accordingly, it can be seen that this technique may be used to overcome the magnetic holding of a lock part in an unlocked position after a period of time deemed the longest necessary for the operator to withdraw the bolt.

One skilled in the art will recognize that the foregoing detailed description is that of the preferred embodiment of the best mode and, therefore, modifications, changes and alternative approaches may be utilized which do not remove the resulting device from the scope of the claims herein.

We claim:

1. An electronic combination lock comprising:

a bolt;

a bolt moving member connected to said bolt for displacing said bolt between an extended and a retracted position;

a control mechanism displaceable to control the position of said bolt moving member;

a displaceable member engageable with and disengageable from said control mechanism for conditioning operation of said control mechanism;

a magnet having a first magnetic field of a first polarity;

a magnetically attracted member, said magnetically attracted member operative to displace said displaceable member and hold said displaceable member in a displaced position;

a coil of wire capable of creating a second magnetic field having a second polarity affecting said magnet;

electrical control circuitry for passing an electrical current through said coil in a direction to create said second magnetic field with a polarity opposite the polarity of said first magnetic field of said magnet, whereby said first magnetic field is neutralized by said second magnetic field and the magnetic attraction on said magnetically attracted member and said magnetically attracted member is freed to be displaced by non-magnetic forces.

2. The electronic combination lock of claim 1 wherein said magnet is a permanent magnet disposed proximate said coil.

3. The electronic combination lock of claim 1 wherein said magnet comprises a solenoid core having residual magnetism.

4. The electronic combination lock of claim 2 wherein said permanent magnet comprises a solenoid core having residual magnetism.

5. The electronic combination lock of claim 2 wherein said electrical control circuitry comprises a microprocessor connected to a transistor control, said transistor control controllingly connected to a capacitor, said capacitor connected to said coil whereby discharge of said capacitor passes said current through said coil creating said second magnetic field.

6. The electronic combination lock of claim 3 wherein said electrical control circuitry comprises a microprocessor connected to a transistor control, said transistor control controllingly connected to a capacitor, said capacitor connected to said coil whereby discharge of said capacitor passes said current through said coil creating said second magnetic field.

7. The electronic combination lock of claim 5 wherein said coil is disposed proximate said magnet and where said second magnetic field is at least partially coextensive with said first magnetic field.

8. The electronic combination lock of claim 6 wherein said coil is disposed proximate said magnet and where said second magnetic field is at least partially coextensive with said first magnetic field.

9. The electronic combination lock of claim 7 wherein said coil is a portion of said solenoid.

10. The electronic combination lock of claim 8 wherein said coil is a portion of said solenoid.

* * * * *